US009709227B2

(12) United States Patent
Patterson

(10) Patent No.: US 9,709,227 B2
(45) Date of Patent: Jul. 18, 2017

(54) LIGHT BLADE FIXTURE AND METHOD OF SERVICING THE SAME

(71) Applicant: David E. Patterson, Rio Rancho, NM (US)

(72) Inventor: David E. Patterson, Rio Rancho, NM (US)

( * ) Notice: Subject to any disclaimer, the term of this patent is extended or adjusted under 35 U.S.C. 154(b) by 272 days.

(21) Appl. No.: 14/698,951

(22) Filed: Apr. 29, 2015

(65) Prior Publication Data

US 2015/0345752 A1 Dec. 3, 2015

Related U.S. Application Data

(60) Provisional application No. 62/006,378, filed on Jun. 2, 2014.

(51) Int. Cl.

| | |
|---|---|
| ***F21V 17/00*** | (2006.01) |
| ***F21S 8/04*** | (2006.01) |
| ***F21V 23/00*** | (2015.01) |
| ***F21V 19/04*** | (2006.01) |
| ***F21S 8/00*** | (2006.01) |
| *F21Y 115/10* | (2016.01) |

(52) U.S. Cl.

CPC ..... *F21S 8/00* (2013.01); *F21S 8/043* (2013.01); *F21V 17/002* (2013.01); *F21V 19/042* (2013.01); *F21Y 2115/10* (2016.08); *Y10T 29/49119* (2015.01)

(58) Field of Classification Search

CPC ..... F21V 19/042; F21V 19/045; F21V 21/02; F21V 21/025; F21V 21/03; F21V 2200/20; F21V 17/002; F21V 17/12; F21V 23/007; F21V 23/009; F21V 23/02–23/026; F21K 9/20; F21K 9/61; G09F 2013/1872; G09F 2013/1877; G09F 2013/1881; G09F 2013/049; G02B 6/0081; G02B 6/0083

See application file for complete search history.

(56) References Cited

U.S. PATENT DOCUMENTS

| | | | | |
|---|---|---|---|---|
| 4,199,803 | A * | 4/1980 | Hunt, III | F21V 21/03 362/145 |
| 5,950,340 | A * | 9/1999 | Woo | G09F 13/04 362/235 |
| 6,294,983 | B1 * | 9/2001 | Lee | G02B 6/0068 340/332 |
| 2009/0009103 | A1 * | 1/2009 | McKechnie | G09F 9/33 315/291 |
| 2011/0047840 | A1 * | 3/2011 | Ou | G02B 6/006 40/546 |

* cited by examiner

*Primary Examiner* — Anh Mai
*Assistant Examiner* — Steven Horikoshi
(74) *Attorney, Agent, or Firm* — Dennis F. Armijo

(57) ABSTRACT

An apparatus, method, and system for changing or removal of a LED driver, a PCB or the lens after installation with one person, and minimal equipment and time and with ease of maintenance without removing the main support structure of the light fixture from a support structure.

15 Claims, 6 Drawing Sheets

LIGHT BLADE FIXTURE AND METHOD OF SERVICING THE SAME

RELATED APPLICATIONS

The present application claims priority to U.S. Provisional Application No. 62/006,378 filed Jun. 2, 2014, assigned to Assignee hereof, and the specification of which is incorporated herein by reference.

BACKGROUND OF THE INVENTION

Field of the Invention (Technical Field)

The present invention relates to LED lighting fixtures and more particularly to a blade style lighting fixture that offers ease of changing the Printed Circuit Board (PCB), driver, and lens, both before and after installation without total removal of the fixture from its mounting surface.

Background Art

There are presently several blade type light fixtures in existence; however, in order to maintain or repair a mounted fixture, total removal of the fixture is required.

SUMMARY OF THE INVENTION (DISCLOSURE OF THE INVENTION)

The presently claimed invention overcomes the shortcomings of the prior art devices by providing an apparatus, method, and system for changing the PCB with one or more mounted LEDs, driver, dimmer or lens, both before and after it is initially installed without demounting the fixture base from the mounting surface.

The preferred apparatus, method, and system comprise a means to attach a power supply to the upper housing and feed AC power cable through the housing and connect/mount upper housing to the desired structure. The preferred method comprises the steps of applying LEDs to lower housing, attaching lens, raising lower housing to upper housing, and connecting the DC power cable from the power supply to the LEDs. Using fasteners, you can now attach the lower housing to the upper housing via housing fasteners. Thus, the lower housing and/or the lens is removable for easy replacement without removal of the entire lighting fixture.

BRIEF DESCRIPTION OF THE DRAWINGS

The accompanying drawings, incorporated herein, form a part of the specification, illustrate several embodiments of the present invention, and together with the description, serve to explain the principles of the invention. The drawings are only for the purpose of illustrating a preferred embodiment of the invention and should not be construed as limiting the invention. In the drawings.

DESCRIPTION OF THE PREFERRED EMBODIMENTS (BEST MODES FOR CARRYING OUT THE INVENTION)

Figure 1:
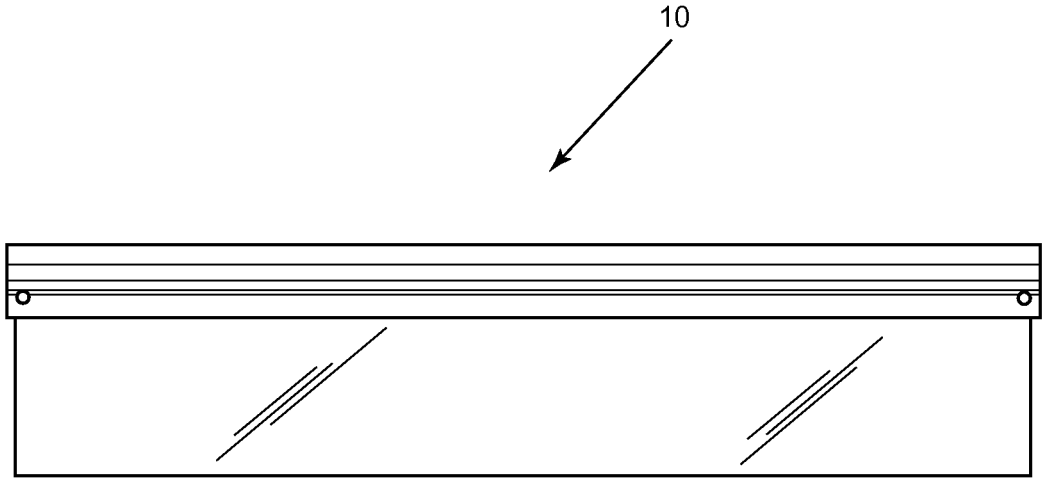
FIG. 1 is a side view of the preferred complete blade light fixture.
Figure 2:
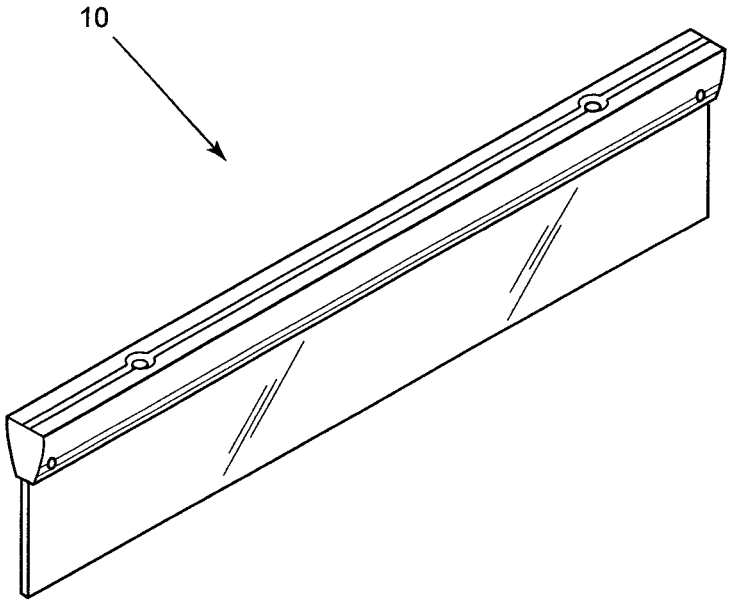
FIG. 2 is a perspective view of FIG. 1.
Figure 3:
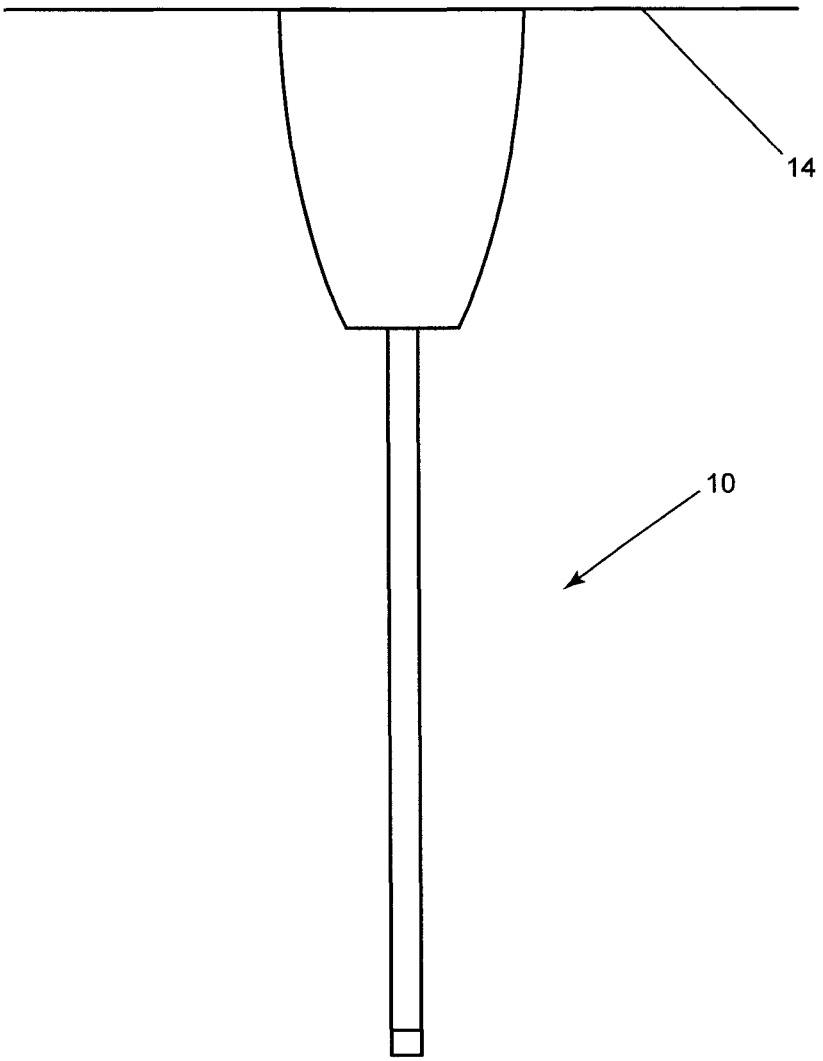
FIG. 3 is a side view of FIG. 1.
Figure 4:
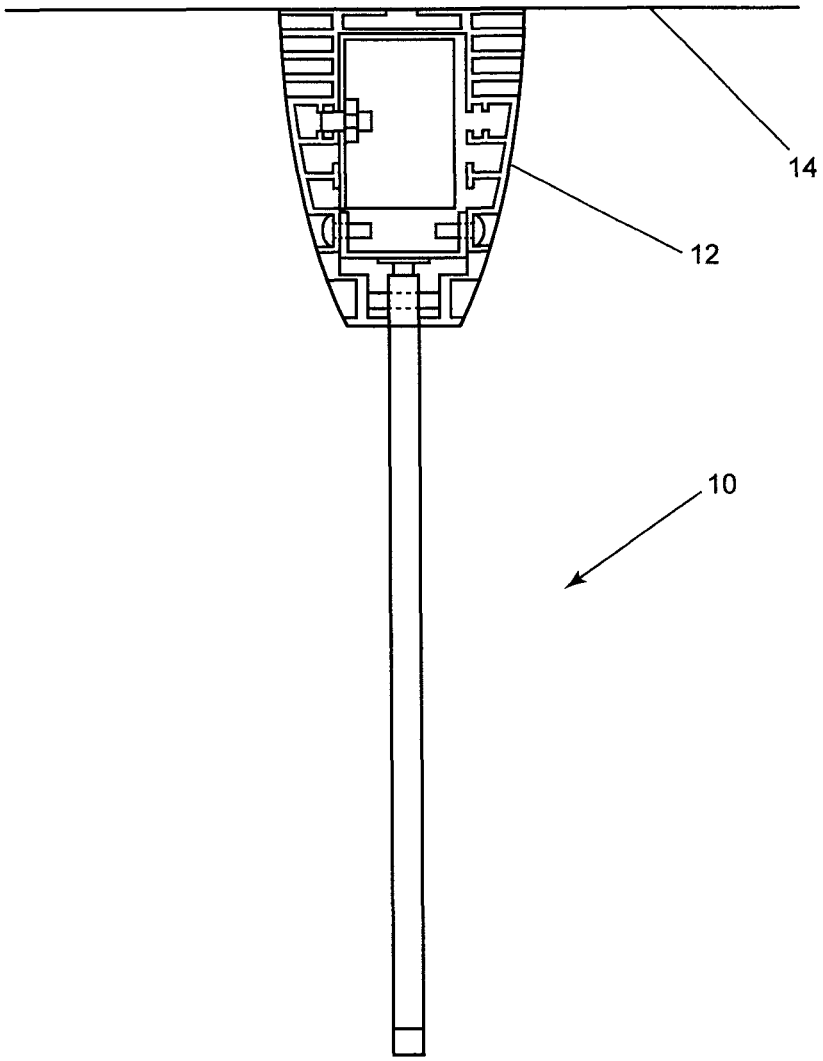
FIG. 4 is a side view of the preferred complete blade light fixture showing the installed internal components.
Figure 5A:
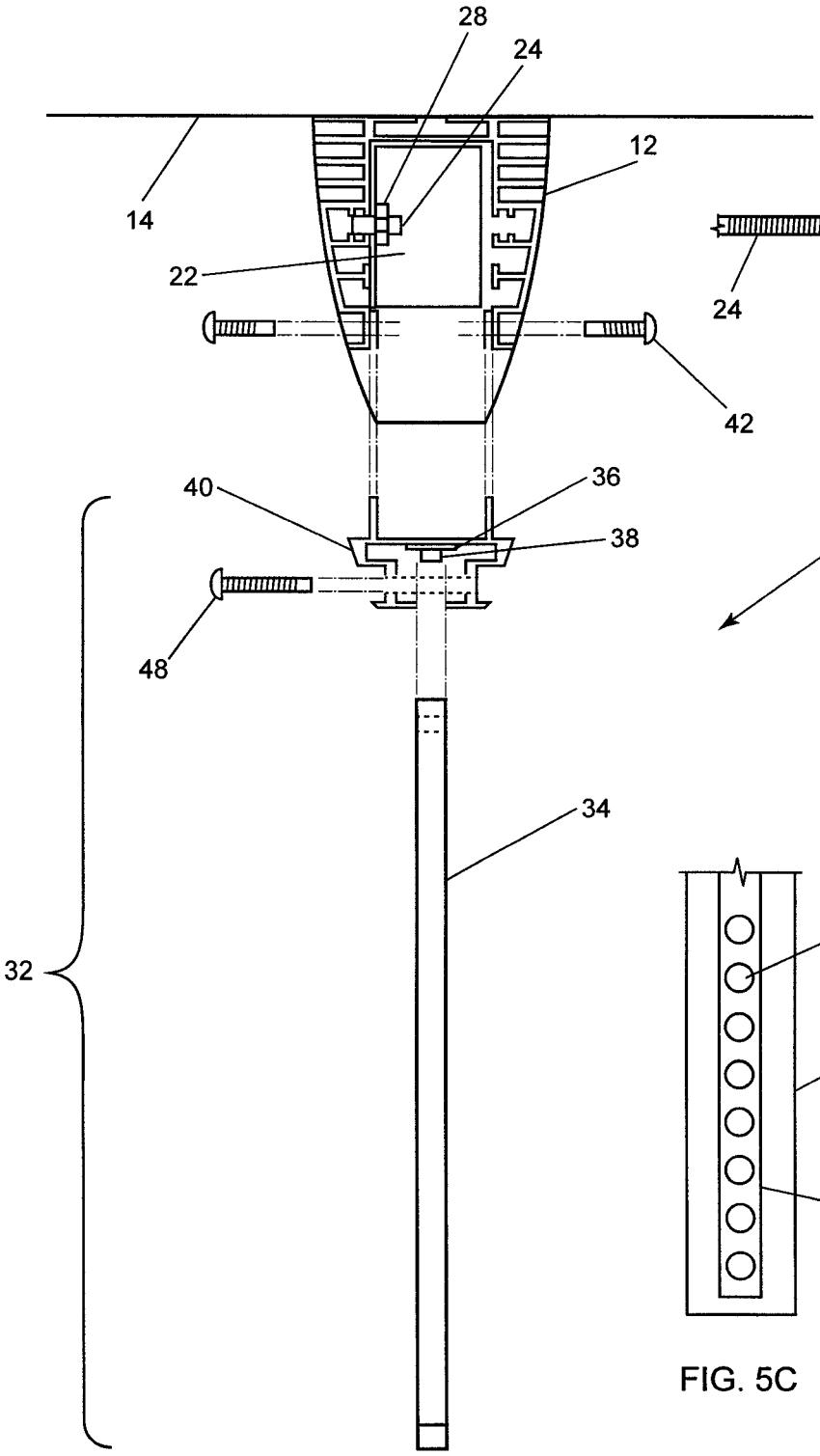
FIG. 5A is a side view of FIG. 4 with the components disassembled.
Figure 5B:
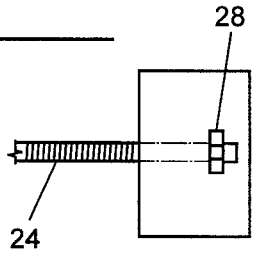
FIG. 5B depicts a T-stud nut for mounting the driver.
Figure 5C:
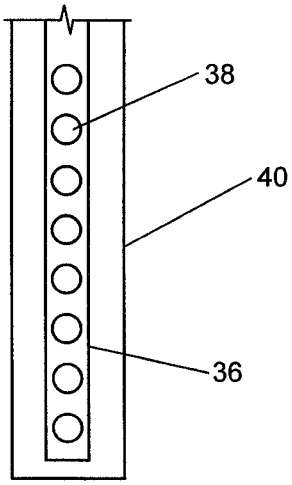
FIG. 5C depicts the PCB containing the LEDs.
Figure 6:
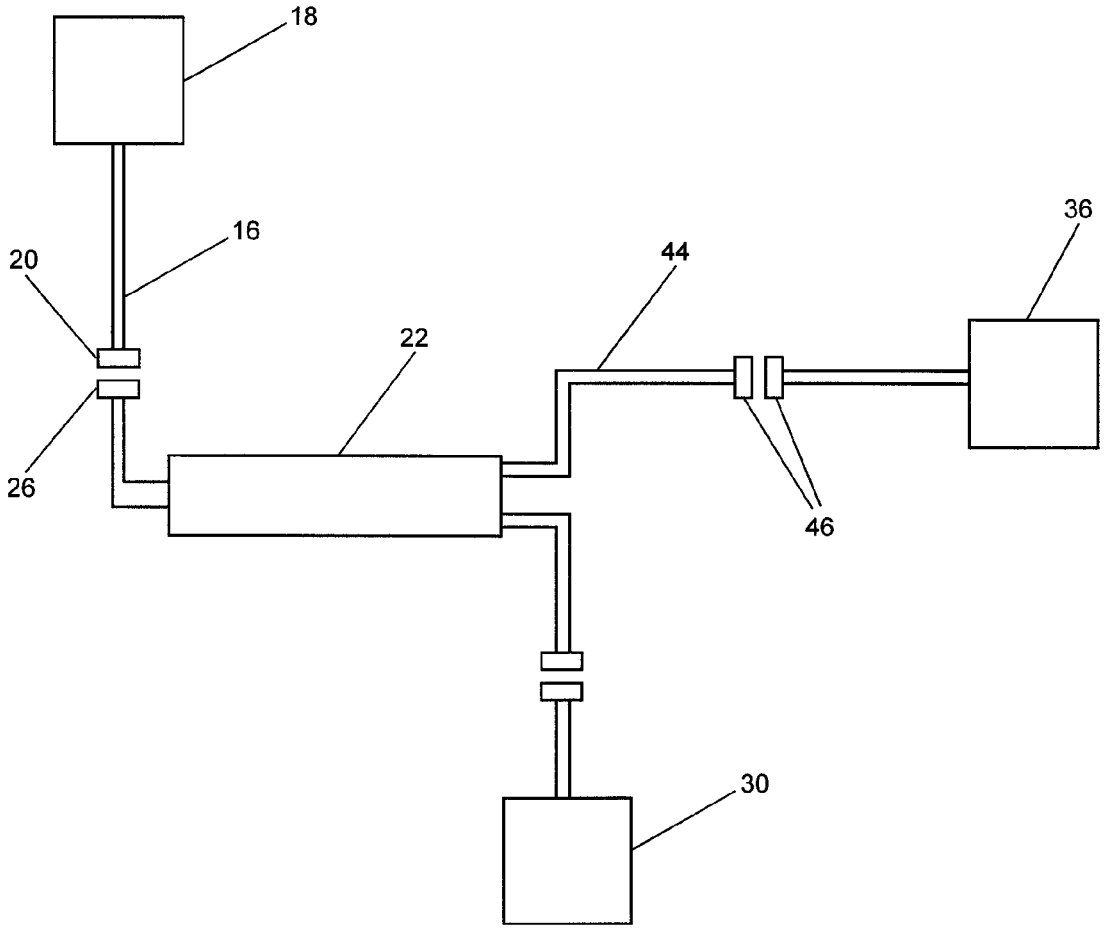
FIG. 6 shows a wiring diagram for the preferred embodiment.

The preferred light blade fixture 10 is shown in FIGS. 1-5. Upper housing 12 is initially secured to the structure 14, such as a ceiling or the like using standard construction techniques. Power harness 16 is connected on one end to a power source 18 and follows local NEC/NFPA 70 codes; is routed through structure 14 into upper housing, and terminated at power connector 20. Driver 22 is installed within upper housing 12 using well-known techniques such as mounting driver 22 with one or more T-studs 24 embedded into upper housing 12 and one or more T-stud nuts 28. Once driver 22 is installed, driver power connector 26 is mated with power connector 20 to supply power to driver 22. The connectors are preferably quick connectors or the like. If a dimmer 30 is being utilized it is electrically connected to driver 22. Driver 22 can be removed and replaced without removing upper housing 12 from structure 14.

Lower housing 32 is a combination of lens 34, preferably a blade lens as shown, PCB 36, one or more LEDs 38 mounted on PCB 36, and bracket 40 for mounting PCB 36 and for mounting and demounting lower housing 32 to upper housing 12, as shown. To demount lower housing 32 from upper housing 12, one or more lower LED housing fasteners 42 are disengaged from bracket 40 and upper housing 12. Lower LED housing fasteners 42 can be pins, screws, spring-loaded pins, or any other well-known fastener in the art. Lower housing 32 is lowered a sufficient distance to disconnect LED harness connectors 46 that are affixed to LED harness 44. It should be noted that LED harness 44 must be of sufficient length to allow this lowering distance for disconnecting a connecting LED harness connector 46. LED harness connectors 46 (a male on one end of harness and a female on the second end of harness) are preferably quick connect type connectors although any well-known type of connectors can be used. Once LED harness 44 is disconnected, lower housing 32 can be lowered and removed to a remote location. To mount lower housing 32 onto upper housing 12, the aforementioned steps are reversed. Lower housing 32 is raised a sufficient distance towards upper housing 12 to permit the connection on LED harness connectors 46. Lower housing 32 is raised to align apertures in bracket 40 and upper housing 12 and lower LED housing fasteners 42 are inserted completing the mounting operation.

Once lower housing 32 has been demounted, driver 22 is exposed and can be removed and replaced. T-stud nuts 28 are disengaged and power connector 26 is disconnected from power connector 20 and the driver 22 and optional dimmer 30 can be removed and replaced.

To replace PCB 36, lower housing 32 is removed from upper housing 12 as described above. PCB 36 can be disengaged from bracket 40 and a new PCB 36 installed and connected via LED harness connector 46.

Replacing lens 34 can be accomplished without removing lower housing 32 from upper housing 12 or after lower housing 32 is removed. To remove lens 34, at least two lens fasteners 48 are disengaged from apertures in bracket 40 and corresponding apertures in lens 34. Once the at least two lens fasteners 48 are removed, lens 34 can be removed and a new lens 34 installed by aligning the bracket apertures and the corresponding lens apertures, and inserting the at least two lens fasteners.

By using the claimed invention, one has accessibility to repair and/or replace components of the luminaire in place.

This provides the capability of butting luminaire's end-to-end for multiple run wiring. The upper housing allows for easy installation and maintenance. The lower housing allows for easy access to upper housing and for maintenance to components. The upper housing is designed in such a way that one can house an integral driver to power the LED's and to align luminaires when mounting end-to-end. The lower housing is designed to allow easy repair/replacement to the LED's and/or lens. It also allows easy access to the power driver in the upper housing.

As components are used to their life expectancy and ultimately need to be replaced or updated this design allows for easy replacement with minimal or no intervention with the mounting structure. If the owner is requesting to update the look of the luminaire, the design allows changes to be made with limited work, tools, or expertise.

Although the claimed invention has been described in detail with particular reference to these preferred embodiments, other embodiments can achieve the same results. Variations and modifications of the presently claimed invention will be obvious to those skilled in the art and it is intended to cover in all such modifications and equivalents. The entire disclosures of all references, applications, patents, and publications cited above, are hereby incorporated by reference.

What is claimed is:

1. A light blade fixture apparatus comprising:

an upper housing permanently affixed to a structure;

a driver removably affixed directly to the upper housing and configured to be removable without removing the upper housing when a LED harness is connected from the driver to at least one LED; and a lower light emitting diode (LED) housing removably affixed to the upper housing and configured to be removable without removing the upper housing, comprising at least two lower LED housing fasteners wherein the lower LED housing comprises:

the at least one LED;

a blade lens; and at least one blade lens fastener, wherein at least one lower housing blade aperture is aligned with at least one blade aperture and wherein the at least one blade lens fastener is inserted into the at least one lower housing blade aperture and the at least one blade aperture.

2. The light blade fixture of claim 1 wherein the at least one lower LED housing further comprises a bracket.

3. The light blade fixture of claim 1 wherein the LED harness is a wiring harness from the driver to the LED.

4. The light blade fixture of claim 3 further comprising a connector in the wiring harness.

5. The light blade fixture of claim 1 further comprises a driver harness from a power source to the driver, wherein the harness comprises a power connector.

6. The light blade fixture of claim 1 further comprises an integral removable dimmer.

7. The light blade fixture of claim 1 wherein the LED comprises a Printed Circuit Board (PCB).

8. A method of servicing a light blade fixture without removing a permanently affixed upper housing, the method comprising the steps of:

removing at least one lower LED housing fastener from a lower LED housing and the permanently affixed upper housing affixed to a structure, the lower LED housing comprising at least one LED and a blade lens and wherein a driver is affixed to the permanently affixed upper housing when a LED harness is connected from the driver to the LED;

lowering the lower LED housing a predetermined distance;

disconnecting the LED harness from the driver affixed to the permanently affixed upper housing to the at least one LED; and removing the lower LED housing, removing a blade lens from the lower housing by removing at least one removable lens fastener from at least one lower housing blade aperture and at least one blade aperture, wherein the at least one lower housing blade aperture is aligned with the at least one blade aperture before the at least one removable lens fastener is removed.

9. The method of claim 8 further comprising the step of removing the driver from the upper housing comprising:

removing at least one driver fastener from the driver and the upper housing;

disconnecting a power harness; and removing the driver.

10. The method of claim 8 wherein the step of disconnecting a harness comprises disconnecting a quick connector.

11. The method of claim 8 further comprising removing a PCB with the at least one LED.

12. A method of servicing a light blade fixture without removing a permanently affixed upper housing, the method comprising the steps of:

raising a lower LED housing a predetermined distance, the lower LED housing comprising at least one LED;

connecting a LED harness from a driver affixed to the permanently affixed upper housing to the at least one LED;

raising the lower LED housing to align at least one lower housing aperture with at least one upper housing aperture; and installing at least one lower LED fastener into the at least one aligned lower housing aperture and the at least one upper housing aperture;

installing a blade lens to the lower LED housing comprising:

raising the blade lens;

aligning at least one lower housing blade aperture with at least one blade aperture; and inserting at least one lens fastener into the housing blade aperture and the at least one blade aperture.

13. The method of claim 12 further comprising installing a PCB with the at least one LED.

14. The method of claim 12 further comprising the step of installing the driver to the upper housing comprising:

connecting a power harness from a power source to the driver; and installing at least one driver fastener into the driver and the upper housing.

15. The method of claim 14 wherein the step of connecting a harness comprises connecting a quick connector.

* * * * *